US007675031B2

(12) United States Patent
Konicek et al.

(10) Patent No.: US 7,675,031 B2
(45) Date of Patent: Mar. 9, 2010

(54) AUXILIARY DRAG FIELD ELECTRODES

(75) Inventors: Michael Konicek, Santa Clara, CA (US); Adrian Land, San Carlos, CA (US); Gershon Perelman, Cupertino, CA (US); Lee Earley, San Jose, CA (US); Mark Hardman, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 140 days.

(21) Appl. No.: 12/129,608

(22) Filed: May 29, 2008

(65) Prior Publication Data

US 2009/0294641 A1 Dec. 3, 2009

(51) Int. Cl.
*H01J 49/42* (2006.01)
*H05H 9/02* (2006.01)

(52) U.S. Cl. ..... 250/286; 250/281; 250/282; 250/290; 313/360.1; 315/111.61

(58) Field of Classification Search ..... 250/286, 250/281, 282, 290; 313/360.1; 215/111.61
See application file for complete search history.

(56) References Cited

U.S. PATENT DOCUMENTS 3,147,445 A 9/1964 Wuerker et al.
5,576,540 A 11/1996 Jolliffe
5,679,950 A 10/1997 Baba et al.
5,783,824 A 7/1998 Baba et al.
5,847,386 A 12/1998 Thomson et al.
6,403,955 B1 6/2002 Senko
6,713,757 B2 3/2004 Tanner et al.
6,791,078 B2 9/2004 Giles et al.
6,800,846 B2 * 10/2004 Bateman et al. ..... 250/281
6,884,995 B2 4/2005 Bateman et al.
6,909,089 B2 6/2005 Londry et al.
6,914,241 B2 * 7/2005 Giles et al. ..... 250/286
7,067,802 B1 6/2006 Kovtoun
7,084,398 B2 8/2006 Loboda et al.
7,095,013 B2 8/2006 Bateman et al.
7,196,324 B2 3/2007 Verentchikov
7,365,317 B2 * 4/2008 Whitehouse et al. ..... 250/292
2007/0278397 A1 * 12/2007 Bateman et al. ..... 250/286
2009/0302209 A1 * 12/2009 Green et al. ..... 250/282

FOREIGN PATENT DOCUMENTS

EP 0290712 B1 11/1990

* cited by examiner

*Primary Examiner*—Nikita Wells
(74) *Attorney, Agent, or Firm*—Michael C. Staggs

(57) ABSTRACT

Auxiliary electrodes for creating drag fields may be provided as arrays of finger electrodes on thin substrates such as printed circuit board material for insertion between main RF electrodes of a multipole. A progressive range of voltages can be applied along lengths of the auxiliary electrodes by implementing a voltage divider that utilizes static resisters interconnecting individual finger electrodes of the arrays. Dynamic voltage variations may be applied to individual finger electrodes or to groups of the finger electrodes.

20 Claims, 4 Drawing Sheets

AUXILIARY DRAG FIELD ELECTRODES

BACKGROUND OF THE INVENTION

1. Field of the Invention

Mass Spectrometers often employ multipole ion guides including collision cells. Ion guides include a plurality of electrodes to which a variety of voltages are applied to contain or move ions radially and/or axially. The present invention relates specifically with apparatuses and methods for moving ions axially by auxiliary rods in multipole ion guides and collision cells.

2. Discussion of the Related Art

In tandem mass spectrometers such as triple stage quadrupole mass spectrometers, and also in other mass spectrometers, gas within the volumes defined by the RF rod sets in ion guides and collision cells improves the sensitivity and mass resolution by a process known as collisional focusing. In such a process, collisions between the gas and the ions cause the velocities of the ions to be reduced, causing the ions to become focused near the axis. However, the slowing of the ions also creates delays in ion transmission through the rod sets, and from one rod set to another. While the focusing is desirable, the slowing of the ions is also accompanied by other undesirable effects.

For example, when a rod set of an ion guide transmits ions from an atmospheric pressure ion source into a mass filter, the gas pressure in the ion guide may be relatively high (e.g. above 5 millitorr for collisional focusing) and collisions with the gas can slow the ions virtually to a stop. Therefore, there is a delay between ions entering the ion guide and the ions reaching the mass filter just downstream. This delay can cause problems in multiple ion monitoring, for example, where several ion intensities are monitored in sequence. If these multiple ions are monitored at a frequency which is faster than the ion transit time through the ion guide, then the fact that at least some of the ions are slowed to a stop has the negative impact of also causing the ions to have a sequence and a reduced rate at which the ions can be detected. The sequence and rate at which the associated data is processed and saved is also affected. In this case the signal from ions entering the ion guide may never reach a steady state. Thus, the measured ion intensity may be too low and may be a function of the measurement time.

Similarly, after product ions have been formed in a collision cell downstream of a first mass filter, for example, the ions may drain slowly out of the collision cell because of their very low velocity after many collisions. The ion clear out time (typically several tens of milliseconds) can cause tailing in the chromatogram and other spurious readings due to interference between adjacent channels when monitoring several parent/fragment pairs in rapid succession. To avoid this, a fairly substantial pause time is needed between measurements. The tailing also requires a similar pause. This required pause time between measurements reduces the productivity of the instrument.

In order to move ions axially through the multipoles forming ion guides and collision cells, it is known that the ions can be moved by segmentation of auxiliary rods and the application of voltages to the segments to create a voltage gradient along a length of the multipoles.

Background information for such a method is described in U.S. Pat. No. 5,847,386, entitled, "Spectrometer With Axial Field," issued Dec. 8, 1998, to Thompson et al., including the following, "In a mass spectrometer, typically a quadrupole, one of the rod sets is constructed to create an axial field, e.g., a DC axial field, thereon. The axial field can be created by tapering the rods, or arranging the rods at angles with respect to each other, or segmenting the rods, or by providing resistively coated or segmented auxiliary rods, or by providing a set of conductive metal bands spaced along each rod with a resistive coating between the bands, or by forming each rod as a tube with a resistive exterior coating and a conductive inner coating, or by other appropriate methods."

Background information on another segmented auxiliary rod structure is described in U.S. Pat. No. 5,576,540, entitled, "Mass Spectrometer With Radial Ejection," to Jolliffe, issued Nov. 19, 1996, including the following, "Each rod 140 is divided into a number of axial segments 140-1 to 140-7, separated by insulators 141 . . . . The voltages on rods 140 create an axial DC field along the central longitudinal axis 142 of the rod set 132."

Background information on other auxiliary electrode structures can also be found in U.S. Pat. No. 3,147,445 to Wuerker et al., U.S. Pat. No. 6,713,757 to Tanner et al., U.S. Pat. No. 6,909,089 to Londry et al and in U.S. Pat. No. 5,783,824, entitled "Ion Trapping Apparatus," issued Jul. 21, 1998, to Baba et al.

The U.S. Pat. No. 7,067,802 to Kovtoun teaches an alternative way of forming an axial voltage gradient for moving ions through a multipole by applying a resistive path to an outer surface of the main electrodes of a multipole and applying a DC voltage to the resistive path.

The U.S. Pat. No. 7,084,398 to Loboda et al. teaches a method of selectively axially ejecting ions from a trap. The abstract explains that the method includes " . . . separating the ions into a first group of ions and a second group of ions by providing an oscillating axial electric field within the rod set to counteract the static axial electric field . . . ".

SUMMARY OF THE INVENTION

Hence, the present invention is directed to auxiliary electrodes that can urge ions axially in ion guides and collision cells. There is a need to provide these auxiliary electrodes at low cost and in a manner that makes it feasible to easily configure the auxiliary electrodes to any shape in order to match curved main electrode sets. Placement of a generally flat or low profile array of finger electrodes on a printed circuit board material enables placement of the auxiliary electrodes formed with these arrays between main RF electrodes in a multipole ion guide or collision cell. The placement can be such that radially inward edges are close to the central axis. Thus, axial voltage gradients created by the voltages applied to the array of finger electrodes can effectively move the ions through the multipole.

Embodiments of the present invention include a mass spectrometer having a multipole ion guide device having an electronic controller and a plurality of main electrodes operably connected to the electronic controller and an RF power source for applying RF voltages in the multipole ion guide device under operation of the electronic controller. The mass spectrometer also has at least one auxiliary electrode connected to a DC voltage source via the controller. Such an auxiliary electrode can be disposed between at least two adjacent ones of the main electrodes. The at least one auxiliary electrode may have electrical elements including at least one array of finger electrodes and a plurality of resistors interconnecting respective finger electrodes of the at least one array. The auxiliary electrode may also include a substrate supporting the finger electrodes and the resistors. The voltage source may apply a static DC voltage to the electrical elements such that the finger electrodes present a monotonically progressive voltage gradient on respective finger electrodes of the array along a length of the auxiliary electrode.

Embodiments of the present invention may also include a mass spectrometer similar to that described above, except that electrical elements include at least one digital to analog converter (DAC) connected to respective finger electrodes of the at least one array of finger electrodes instead of or in addition to the resistors. Also, the DC voltage source may apply one or more DC voltage to the finger electrodes by the at least one DAC for presenting a voltage gradient on the respective finger electrodes of the at least one array along a length of the at least one auxiliary electrode for moving ions axially through the multipole ion guide device of the mass spectrometer. In this arrangement, the at least one DAC may include a programmable logic control that can be dynamically adjusted.

In another example arrangement, embodiments of the present invention may include a method of moving ions through a multipole ion guide device in a mass spectrometer. The method may include disposing an auxiliary electrode comprising a thin plate between adjacent main RF electrodes of the multipole ion guide device. The method may also include applying at least one step-wise monotonic range of voltages in an axial direction by at least one array of finger electrodes disposed on the thin plate of the auxiliary electrode. The method may include applying respective voltages in steps to the finger electrodes through respective resistors, and monotonically moving ions through the multipole ion guide device in the axial direction by the range of voltages.

In still another configuration, embodiments of the present invention may include a method similar to that described above, with the exceptions of applying respective DC voltages to the finger electrodes by one or more computer controlled voltage supply instead of, or in addition to, applying the DC voltages by the resistors. The computer controlled voltage supply may include a DAC.

It is to be understood that embodiments of the present invention may include the auxiliary electrodes that may be applied to the mass spectrometers and methods described above. In a simple form, the embodiments of the present invention may thus include an auxiliary electrode for creating an ion moving axial electric field in a multipole ion guide device of a mass spectrometer. The auxiliary electrode may include at least one substrate for supporting electrical elements of the auxiliary electrode. The at least one substrate may be configured to be positioned between at least two adjacent ones of main electrodes of the multipole ion guide device. The electrical elements may include an array of finger electrodes disposed on the at least one substrate, and static resistors interconnecting respective ones of the finger electrodes for setting up a monotonically progressive voltage gradient in an axial direction of the multipole ion guide device for moving ions axially through the multipole ion guide device. In another simple form, the auxiliary electrode may include at least one DAC instead of or in addition to the resistors, as described above. The at least one DAC may be a dynamically adjustable DAC.

The at least one substrate may include a thin plate. The array of finger electrodes may be disposed on the thin plate. The electrical elements may have a low profile or be integral with the thin plate such that the substrate with the electrical elements form a monolithic unit for positioning between the at least two adjacent electrodes of the multipole ion guide device. In one case, the thin plate may include a printed circuit board material and the array of finger electrodes may include a printed conductive material.

DETAILED DESCRIPTION

Figure 1:
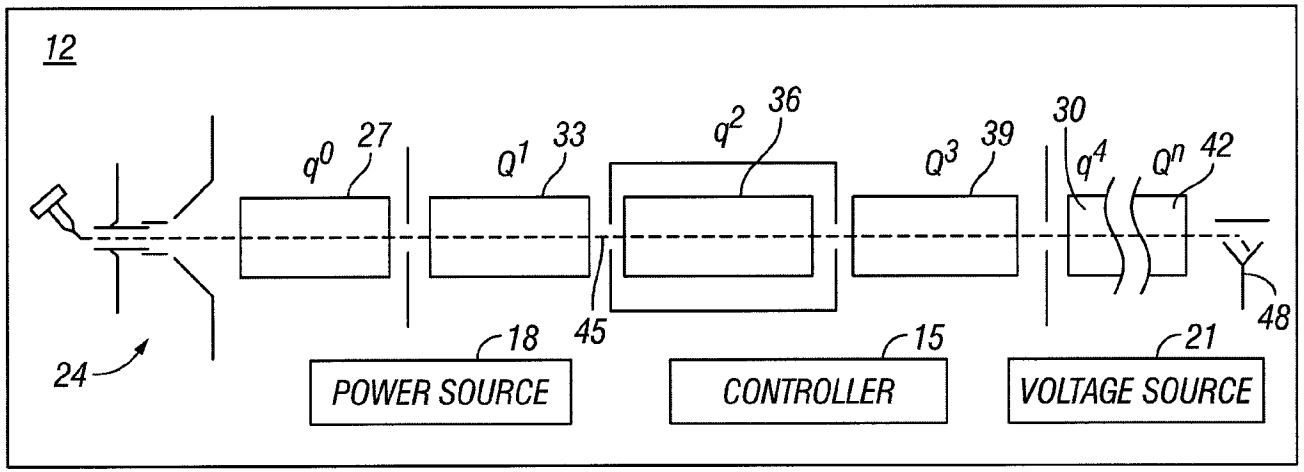
FIG. 1 shows a basic diagrammatic view of a mass spectrometer having one or more ion guides and/or collision cells in accordance with embodiments of the present invention.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Additionally, it will be understood that any list of such candidates or alternatives is merely illustrative, not limiting, unless implicitly or explicitly understood or stated otherwise. It is also to be understood, where appropriate, like reference numerals may refer to corresponding parts throughout the several views of the drawings for simplicity of understanding.

Moreover, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

Turning now to the drawings, FIG. 1 shows a basic view of a mass spectrometer of the present invention, generally designated by the reference numeral 12, which often can include an ion guide or collision cell $q^0$, $q^2$, $q^4$ in accordance with the exemplary embodiments as disclosed herein. Such a mass spectrometer may also include an electronic controller 15, a power source 18 for supplying an RF voltage to the multipole devices disclosed herein, in addition to a voltage source 21 configured to supply DC voltages to predetermined devices, such as, for example, multipole and other electrode structures of the present invention.

In other example arrangements, mass spectrometer 12 often may be configured with an ion source and an inlet section 24 known and understood to those of ordinary skill in the art, of which, such sections can include, but are not limited to, electrospray ionization, chemical ionization, thermal ionization, and matrix assisted laser desorbtion ionization sections. In addition, mass spectrometer 12 may also include any number of ion guides ($q^0$) 27, ($q^4$) 30, mass filters ($Q^1$) 33, collision cells ($q^2$) 36, and/or mass analyzers ($Q^3$) 39, ($Q''$) 42, wherein the mass analyzers 39, 42, may be of any type, including, but not limited to, quadrupole mass analyzers, two dimensional ion traps, three dimensional ion traps, electrostatic traps, and/or Fourier Transform Ion Cyclotron Resonance analyzers.

The ion guides 27, 30, collision cells 36, and analyzers 39, 42, as known to those of ordinary skill in the art, can form an ion path 45 from the inlet section 24 to at least one detector 48. Any number of vacuum stages may be implemented to enclose and maintain any of the devices along the ion path at a lower than atmospheric pressure. The electronic controller 15 is operably coupled to the various devices including the pumps, sensors, ion source, ion guides, collision cells and detectors to control the devices and conditions at the various locations throughout the mass spectrometer 12, as well as to receive and send signals representing the particles being analyzed.

As described above, many ion guides and collision cells suffer from the trade off of slowing the ions down during ion transport when a gas is used to cool the ions and move them toward a central axis. Various mechanisms have been utilized to urge the ions along the ion path 45, as shown in FIG. 1, toward the detector 48 through each of the devices, as discussed above with respect to FIG. 1. However, there is still a need for a mechanism that does not interfere with the electrical fields of predetermined rod electrodes, (e.g., quadrupole electrodes) and cost effectiveness and adaptability to a variety of ion guide and collision cell configurations.

Figure 2:
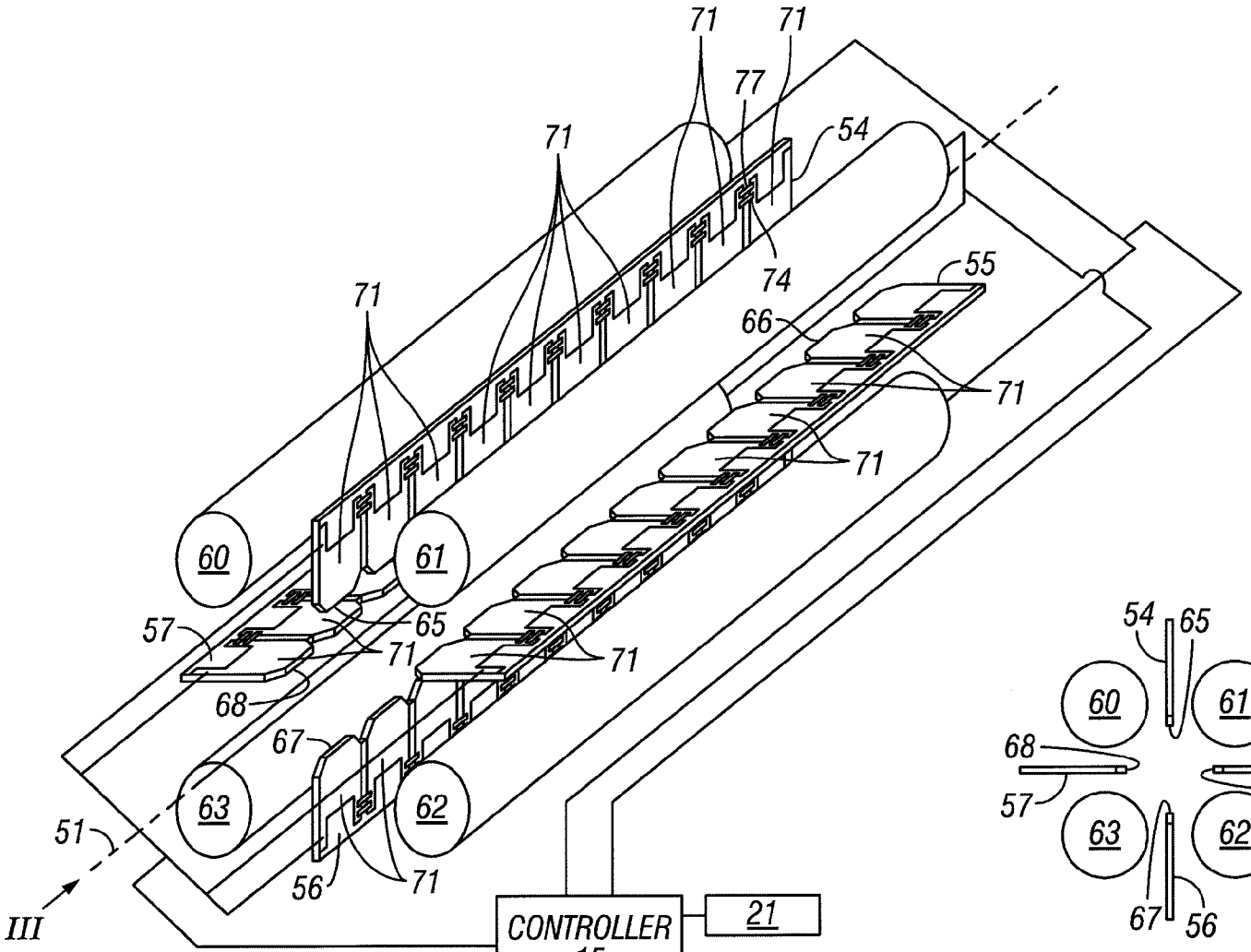
FIG. 2 is a diagrammatic perspective view of a multipole ion guide in accordance with an embodiment of the present invention.
Figure 3:
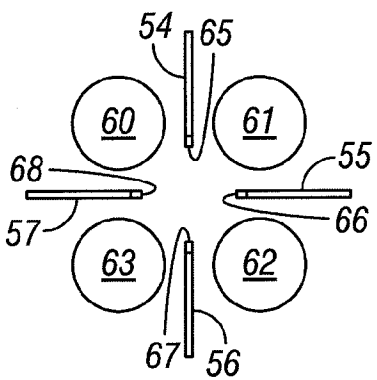
FIG. 3 shows an end view of the multipole ion guide of FIG. 2.

FIG. 2 shows an example configuration to address such needs, wherein auxiliary electrodes 54, 55, 56, 57, configured with one or more finger electrodes 71, are designed to be disposed between adjacent pairs of main rod electrodes 60, 61, 62, 63 of any one of the ion guides 27, 30, and/or collision cell 36 of FIG. 1. The relative positioning of the main rod electrodes 60, 61, 62, 63 and auxiliary electrodes 54, 55, 56, 57 in FIG. 2 is somewhat exploded for improved illustration. However, the auxiliary electrodes can occupy positions that generally define planes that intersect on a central axis 51, as shown by the directional arrow as referenced by the Roman Numeral III. These planes can be positioned between adjacent RF rod electrodes at about equal distances from the main RF electrodes of the multipole ion guide device where the quadrupolar fields are substantially zero or close to zero, for example. Thus, the configured arrays of finger electrodes 71 can lie generally in these planes of zero potential or close to zero potential so as to minimize interference with the quadrupolar fields. FIG. 3 shows and end view perspective of the configuration of FIG. 2, illustrating how the radial inner edges 65, 66, 67, and 68 of the auxiliary electrodes 54, 55, 56, and 57, may be positioned relative to the main rod electrodes 60, 61, 62, 63.

Turning back to FIG. 2, as known to those of ordinary skill in the art, opposite RF voltages may be applied to each pair of oppositely disposed main RF electrodes by the electronic controller to contain the ions radially in a desired manner. The array of finger electrodes 71, which are configured on the each of the auxiliary electrodes 54, 55, 56, 57, are often designed in the present invention to extend to and/or form part of the radially inner edges 65, 66, 67, 68 of such structures. Thus, a voltage applied to the array of finger electrodes 71 creates an axial electric field in the interior of the ion guide 27, 30 or collision cell 36 depicted in FIG. 1. As another example arrangement, each electrode of the array of finger electrodes 71 may be connected to an adjacent finger electrode 71 by a predetermined resistive element 74 (e.g., a resistor) and in some instances, a predetermined capacitor 77. The desired resistors 74 set up respective voltage dividers along lengths of the auxiliary electrodes 54, 55, 56, 57. The resultant voltages on the array of finger electrodes 71 thus form a range of voltages, often a range of step-wise monotonic voltages. The voltages create a voltage gradient in the axial direction that urges ions along the ion path 45, as shown in FIG. 1. In the example embodiment shown in FIG. 2, the voltages applied to the auxiliary rod electrodes often comprise static voltages, and the resistors often comprise static resistive elements. The capacitors 77 reduce an RF voltage coupling effect in which the RF voltages applied to the main RF rod electrodes 60, 61, 62, 63 typically couple to and heat the auxiliary rod electrodes 54, 55, 56, 57 during operation of the RF rod electrodes 60, 61, 62, 63.

Figure 4:
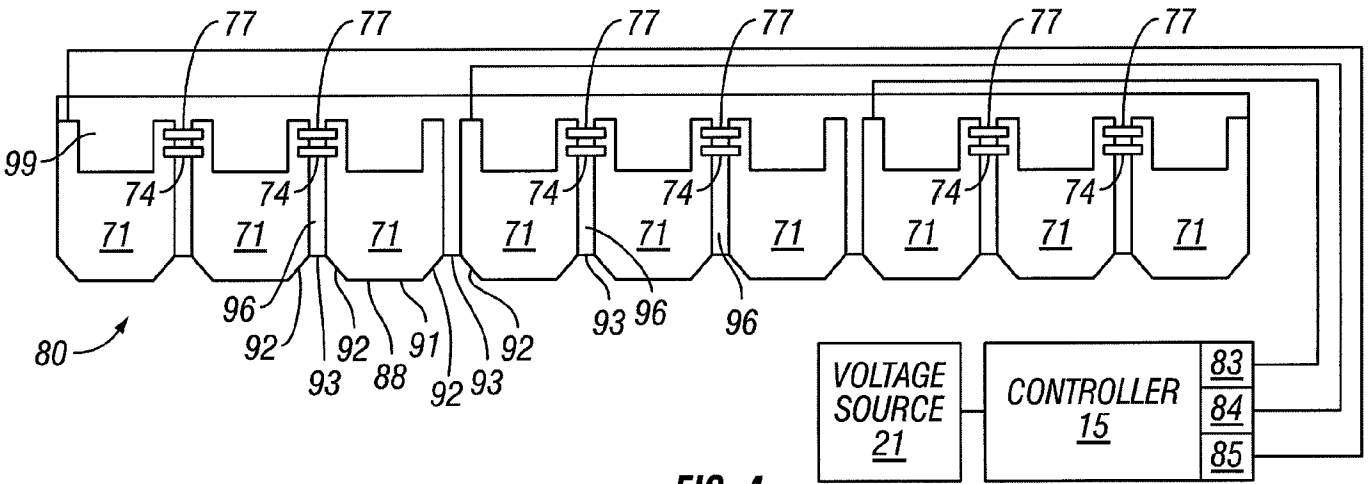
FIG. 4 is a diagrammatic top view of an auxiliary electrode structure in accordance with an alternative embodiment of the present invention.

In an alternative embodiment, as shown in FIG. 4, one or more of the auxiliary electrodes can be provided by an auxiliary electrode, as shown generally designated by the reference numeral 80, which has dynamic voltages applied to one or more of the array of finger electrodes 71. In this example arrangement, the controller 15, as shown in FIG. 1, may include or have added thereto computer controlled voltage supplies 83, 84, 85, which may take the form of Digital-to-Analogue Converters (DACs). It is to be understood that there may be as many of these computer controlled voltage supplies 83, 84, 85 as there are finger electrodes 71 in an array, and that each computer controlled voltage supply may be connected to and control a voltage of a respective finger electrode 71 for the array. As an alternate arrangement, each of the finger electrodes 71 at a particular axial position for all of the arrays in a multipole device may be connected to the same computer controlled voltage supply and have the same voltage applied. In the example embodiment shown in FIG. 4, each computer controlled voltage supply 83, 84, 85, can be connected to predetermined finger electrodes 71 of the array. When implemented on plural auxiliary electrodes, each computer controlled voltage supply 83, 84, 85, may be applied to a like plurality of each array of finger electrodes 71.

As shown in FIG. 4, and as briefly discussed above, the auxiliary electrode 80, may as one arrangement, have designed voltages applied by a combination of dynamic computer controlled voltage supplies and voltage dividers in the form of static resistors 74 so as to form an overall monotonically progressive range of voltages along a length of a multipole device. The static resistors 74 between the finger electrodes 71 within a group of finger electrodes 71 that are connected to a respective computer controlled voltage supplies 83, 84, 85, may further provide a voltage divider that contributes to the creation of a monotonically progressive voltage gradient. Because the voltage supplies 83, 84, 85 are capable of being dynamically controlled via, for example, a computer, the magnitude and range of voltages may be adjusted and changed to meet the needs of a particular sample or set of target ions to be analyzed. As also shown in FIG. 4, capacitors 77 may be connected between adjacent finger electrodes 71. It is to be appreciated, that even though there are two leads shown on each of the finger electrodes 71, a single lead having coupled resistors and capacitors on each side can be also be utilized to depict the interconnection of adjacent finger electrodes so as to still function similarly to the example configuration of FIG. 4.

FIG. 4 also shows in detail, the configuration of a radially inner edge 88 that is similar to the radially inner edges 65, 66, 67, 68, described above for FIG. 2 and FIG. 3. The radially inner edge 88 includes a central portion 91 that may be metalized or otherwise provided with a conductive material, tapered portions 92 that straddle the central portion 91, and a recessed gap portion 93. The central portions 91 may be metalized in a manner that connects metallization on both the front and the back of the auxiliary electrode 80 for each of the finger electrodes 71 of the array of finger electrodes. As an innermost extent of the auxiliary electrode 80, the central portion 91 presents the DC electrical potential in close proximity to the ion path. Gaps 96 including recessed gap portions 93 are needed between metallization of the finger electrodes 71 in order to provide an electrical barrier between respective finger electrodes. However, these gaps offer a resting place for charged particles such that charged particles may reside on the surfaces in the gaps and adversely affect the gradient that is intended to be created by the voltages applied to the finger electrodes 71. Thus, the non-metalized edge surfaces of the tapered portions 92 and the recessed gap portions 93 are tapered back and away from the radially innermost extent such that the edge surfaces of the tapered portions 92 and the recessed gap portions 93 are not as accessible as dwelling places for charged particles.

A structural element for receiving and supporting metallization may be a substrate 99, as shown in FIG. 4, of any printed circuit board (PCB) material, such as, but not limited to, fiberglass, that can be formed, bent, cut, or otherwise shaped to any desired configuration so as to be integrated into the working embodiments of the present invention. Although FIGS. 2-4 show the substrates being substantially flat and having straight edges, it is to be understood that the substrates and the arrays of finger electrodes thereon may be shaped with curved edges and/or rounded surfaces. Substrates that are shaped and metalized in this way are relatively easy to manufacture. Thus, auxiliary electrodes in accordance with embodiments of the present invention may be configured for placement between curved main rod electrodes of curved multipoles.

Figures 5, 6:
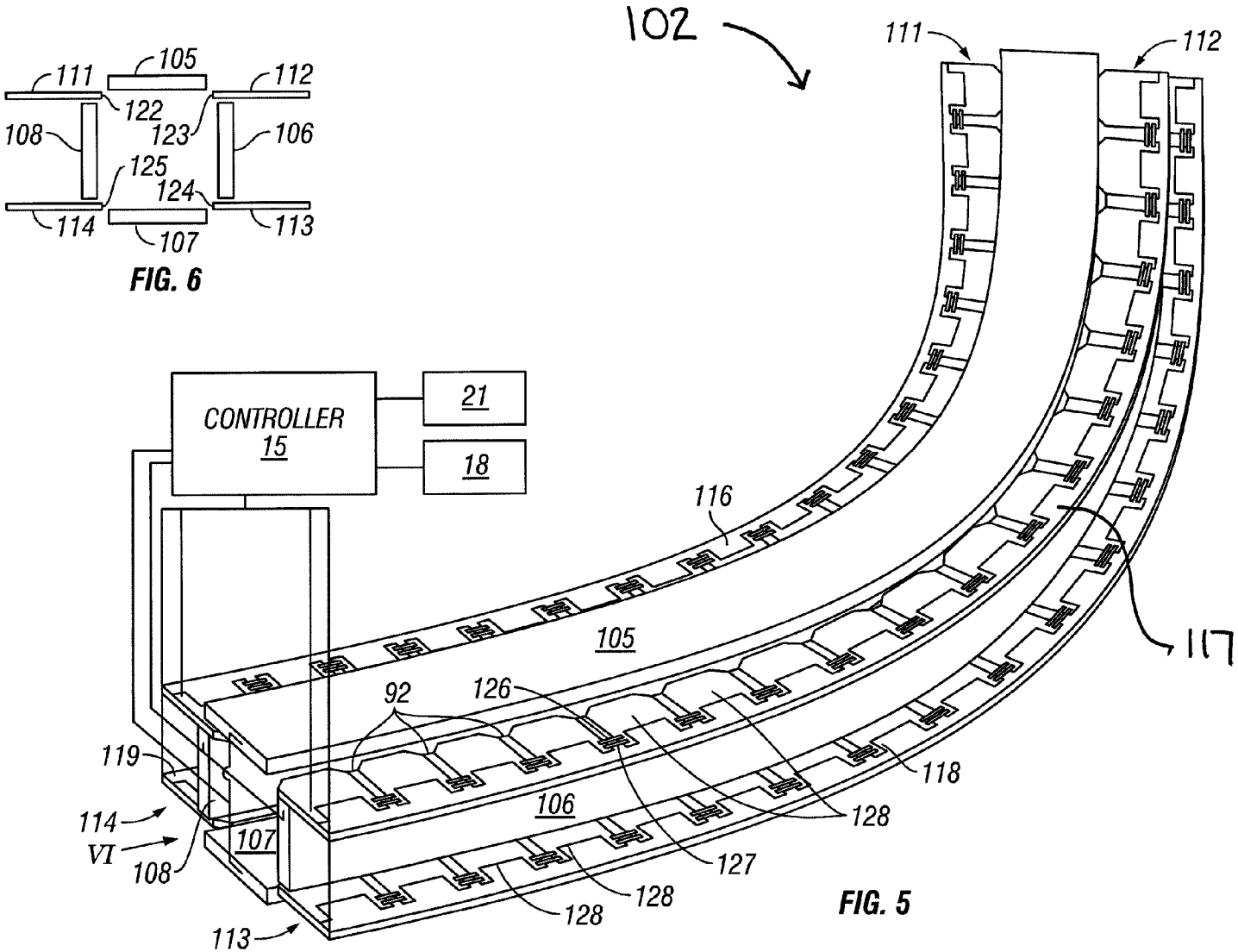
FIG. 5 shows a perspective view of electrodes configured for a multipole ion guide in accordance with another example configuration of the present invention.
FIG. 6 shows an end view perspective of the curved ion guide structure illustrated in FIG. 5.

FIG. 5 is a diagrammatic perspective view of a curved multipole device, generally designated by the reference numeral 102. The multipole ion device 102 may be an ion guide or collision cell, and may be incorporated in the mass spectrometer 12, as shown in FIG. 1, in place of any of ion guides 27, 30 or collision cell 36, also as shown in FIG. 1. The multipole device 102 has main RF electrodes 105, 106, 107, and 108 that are connected to the controller 15, as shown in FIG. 1, for application of the RF voltages from a power source 18, also as shown in FIG. 1, as described with regard to the embodiment of FIG. 2 as discussed above. The main RF electrodes may be formed of rectangular cross sectional material for reduced cost and ease of manufacture. The main RF electrodes may also be curved about one or more axes to provide a desired ion path and/or mass spectrometer configuration. In order to utilize auxiliary electrodes 111, 112, 113, 114, the substrates 116, 117, 118, 119 are shaped to match the curvature of the main RF electrodes. In a method of operation, the auxiliary electrodes 111, 112, 113, 114 are inserted between the main electrodes 105, 106, 107, 108 and DC voltages are applied to the auxiliary electrodes 111, 112, 113, 114 as has been described with regard the embodiments of FIGS. 2-4.

In the end view perspective of FIG. 6 taken in a direction of arrow VI of FIG. 5, first and second auxiliary electrodes 111 and 112 are oriented to substantially form a continuous surface if extended to meet together inside the main RF electrodes 105, 106, 107, 108. Similarly, third and fourth auxiliary electrodes 113, 114 are aligned with each other. These generally co-planar orientations of pairs of the auxiliary electrodes 111, 112, and 113, 114 provide greater ease of manufacturing. Nevertheless, the radially innermost edges 122, 123, 124, 125 are presented between adjacent ones of the main RF electrodes 105, 106, 107, 108, as shown in FIG. 6, and as described with regard to the embodiments of FIGS. 2-4 above.

As may be appreciated from FIG. 5, metallization on an underside of a particular substrate, e.g., substrate 117, may be a mirror image of the metallization on an upper surface of another predetermined substrate, e.g., substrate 118. Similar to the embodiments described above, resistors 122 and capacitors 126 may interconnect adjacent finger electrodes 128 to provide a voltage divider along a length of the multipole device 102. Alternatively a DAC may be connected to each respective finger electrode 128 in an array. Alternatively, a DAC may be connected to a group of finger electrodes 128, which are in turn connected to each other by resistors 126 as shown and described with regard to the embodiment of FIG. 4. That is, DACs and/or resistors may be connected to the auxiliary electrodes to apply and control DC electric voltages to the auxiliary electrodes in any combination without departing from the spirit and scope of the invention.

As with the other example embodiments, the array of finger electrodes 128 is disposed on opposite sides of the circuit board material that forms each of the substrates 116, 117, 118, 119. Similar to the other example embodiments described above, the array of finger electrodes 128 may include a printed or otherwise applied conductive material on an edge of the printed circuit board material that joins the conductive material on opposite sides of the circuit board material. In this way, the array of finger electrodes presents the conductive material on a majority of a radially innermost edge surface of the auxiliary electrode. Also similar to the other embodiments, there are recesses 92 in the edges of the circuit board material between respective finger electrodes 128 of the finger electrode array. Thus, available sites for ion deposit on an insulative material surface of the circuit board material are recessed radially outward away from the ion beam or path.

As with the other embodiments, the printed circuit board material utilized in forming the auxiliary electrodes for the embodiment of FIGS. 5 and 6 may provide a structural foundation or substrate for the conductive material of metallization of the finger electrodes 128. The auxiliary electrodes, e.g., 111, 112, may include curved thin plates forming curved substrates for positioning between two curved adjacent main electrodes of a multipole device 102. The array of finger electrodes 128 may be disposed on the curved thin plates. In this and the other embodiments, the substrates may take the form of thin plates. The array of finger electrodes may be disposed on the thin plates. The electrical elements, including any resistors and capacitors, may be provided with low profiles or may be integral with the thin plates such that the substrate with the electrical elements forms a monolithic unit for positioning between the at least two adjacent main electrodes of multipole devices.

Figure 7:
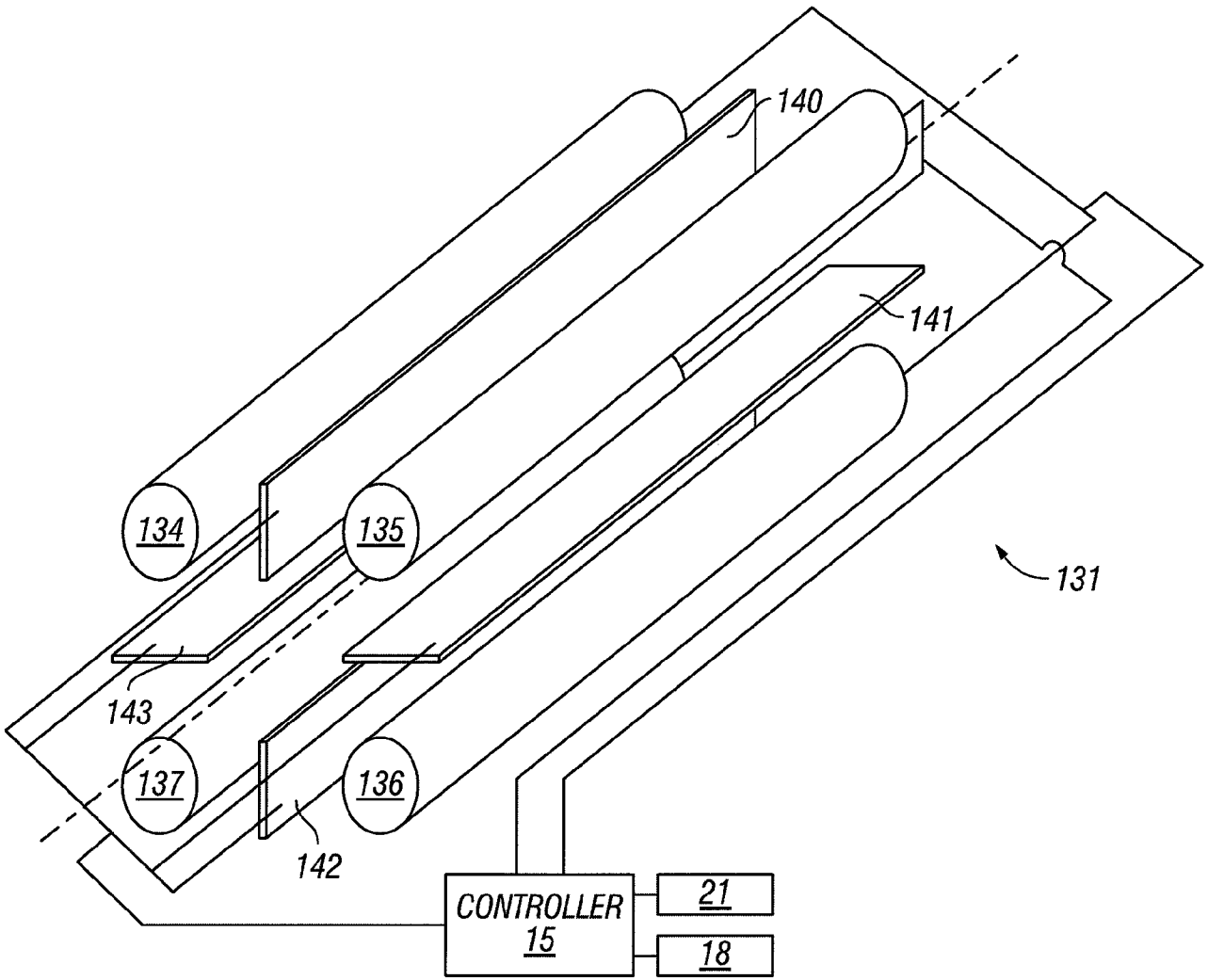
FIG. 7 illustrates another novel multipole configuration of the present invention.

FIG. 7 is an exploded diagrammatic perspective view of a multipole device 131 in accordance with an alternative embodiment of the present invention. The multipole device 131 may have main RF electrodes 134, 135, 136, 137 similar to the embodiments of FIGS. 2-3. Alternatively, the main rod electrodes could have rectangular cross sections as in the embodiment of FIGS. 5 and 6. With respect to the configuration of FIG. 7, however, the auxiliary electrodes 140, 141, 142, 143 can be formed as vanes of a thin semiconductive material such as, but not limited to, Silicon Dioxide. More importantly, the auxiliary electrodes 140, 141, 142, 143 can be configured to have a resistance in a direction along their lengths for creating an axial DC field when an electrical potential is applied. Thus, the auxiliary electrodes may function similarly to those described above even though they do not have discrete finger electrodes or electrical elements that form a voltage divider. Rather, the vanes may have a constant resistance along their lengths, which creates a linear axial DC field when DC voltages are applied to auxiliary electrodes. Alternatively, the vanes may have a varying cross section so that the voltage gradient along a length of the auxiliary electrodes 140, 141, 142, 143 varies. As another example arrangement, the material of the vanes forming the auxiliary electrode can be doped to apply the desired variation in resistance so as to create the varied axial DC field.

In all of the embodiments, the auxiliary electrodes may be applied to less than an entire length of a multipole device. While a monotonically progressive change in voltages along a length of the auxiliary electrodes has been discussed, it is to be understood that other non-monotonically progressive changes in voltages may be applied. For example, slowing voltages may be applied in an upstream end of the multipole device such that less collision gas is needed in a collision cell. Then, accelerating voltages may be applied in a downstream end of the multipole device to keep the ions moving through and out of the device. Additionally, DACs or other computer controlled voltage supplies may be utilized to dynamically vary voltages applied to the auxiliary electrodes in place of or in addition to static DC voltage supplies.

It is to be understood that a mass spectrometer can function with only one auxiliary electrode inserted between any adjacent pair of main RF electrodes. However, a more evenly distributed axial DC field is created by a plurality of auxiliary electrodes disposed between respective pairs of adjacent main RF electrodes in the multipole device of any of the embodiments disclosed herein. This is especially so when the same or similar voltage gradient is created in each of the auxiliary electrodes along respective lengths of the auxiliary electrodes.

What is claimed is:

1. A mass spectrometer having a multipole ion guide device, comprising:

an electronic controller;

a plurality of main electrodes operably connected to the electronic controller and an RF power source for applying RF voltages in the multipole ion guide device under operation of the electronic controller;

at least one auxiliary electrode connected to a DC voltage source via the controller, the at least one auxiliary electrode disposed between at least two adjacent ones of the main electrodes, the at least one auxiliary electrode comprising:

electrical elements including at least one array of finger electrodes and a plurality of resistors interconnecting respective finger electrodes of the at least one array; and a substrate supporting the finger electrodes and the resistors;

wherein the voltage source applies a static DC voltage to the electrical elements such that the finger electrodes present a monotonically progressive voltage gradient on respective finger electrodes of the array along a length of the auxiliary electrode.

2. The mass spectrometer of claim 1, wherein the electronic controller and the resistors limit the voltage applied to the one or more auxiliary electrode to a monotonic voltage gradient.

3. The mass spectrometer of claim 1, further comprising a plurality of auxiliary electrodes including the at least one auxiliary electrode, wherein the plurality of auxiliary electrodes are disposed between respective pairs of adjacent main electrodes in the multipole ion guide device.

4. The mass spectrometer of claim 1, wherein the array of finger electrodes of each auxiliary electrode lies generally in a plane for positioning the array of finger electrodes between the at least two adjacent main electrodes of the multipole ion guide device.

5. The mass spectrometer of claim 1, wherein:

the at least one auxiliary electrode comprises one or more curved thin plates forming one or more curved substrates including the at least one substrate for positioning the one or more curved substrates between curved ones of the at least two adjacent main electrodes of the multipole ion guide device; and the array of finger electrodes disposed on the one or more curved thin plates.

6. A mass spectrometer having a multipole ion guide comprising:

an electronic controller;

a plurality of main electrodes operably connected to the controller and an RF voltage source for applying RF voltages to main electrodes in the multipole ion guide device under operation of the controller;

at least one auxiliary electrode connected to a DC voltage source via the controller, the at least one auxiliary electrode disposed between at least two adjacent ones of the main electrodes of multipole ion guide device, the at least one auxiliary electrode comprising:

electrical elements including at least one array of finger electrodes and at least one digital to analog converter (DAC) connected to respective finger electrodes of the at least one array of finger electrodes; and at least one substrate supporting the finger electrodes;

wherein the DC voltage source applies one or more DC voltage to the finger electrodes by the at least one DAC for presenting a voltage gradient on the respective finger electrodes of the at least one array along a length of the at least one auxiliary electrode for moving ions axially through the multipole ion guide device of the mass spectrometer.

7. The mass spectrometer of claim 6, wherein the at least one DAC includes a programmable logic control and can be dynamically adjusted.

8. The mass spectrometer, of claim 6, wherein the electrical elements further comprise resistors interconnecting respective ones of the finger electrodes for a monotonically progressive voltage gradient between the respective ones of the finger electrodes.

9. The mass spectrometer of claim 6, further comprising a plurality of auxiliary electrodes including the at least one auxiliary electrode, wherein the plurality of auxiliary electrodes are connected to the DC voltage source and are disposed between respective pairs of adjacent main electrodes of the multipole ion guide device.

10. The mass spectrometer of claim 6, wherein the array of finger electrodes lies generally in a plane for positioning between the at least two adjacent main electrodes of the multipole ion guide device.

11. The mass spectrometer of claim 6, wherein:

the at least one auxiliary electrode comprises one or more curved thin plates forming one or more curved substrates including the at least one substrate;

the one or more curved substrates is positioned between curved ones of the at least two adjacent main electrodes; and the array of finger electrodes is disposed on the one or more curved thin plates.

12. A method of moving ions through a multipole ion guide device in a mass spectrometer, the method comprising:

disposing an auxiliary electrode comprising a thin plate between adjacent main RF electrodes of the multipole ion guide device;

applying at least one step-wise monotonic range of voltages in an axial direction by at least one array of finger electrodes disposed on the thin plate of the auxiliary electrode;

applying respective voltages in steps to the finger electrodes through respective resistors; and monotonically moving ions through the multipole ion guide device in the axial direction by the monotonic range of voltages.

13. A method of moving ions through a multipole ion guide device in a mass spectrometer, the method comprising:

disposing an auxiliary electrode comprising a thin plate between adjacent main electrodes of the multipole ion guide device;

applying at least one range of voltages in an axial direction by at least one array of finger electrodes disposed on the thin plate of the auxiliary electrode;

applying respective DC voltages to the finger electrodes by one or more computer controlled voltage supply; and moving ions through the multipole ion guide device in the axial direction by the range of voltages.

14. An auxiliary electrode for creating an ion moving axial electric field in a multipole ion guide device of a mass spectrometer, the auxiliary electrode comprising:

at least one substrate for supporting electrical elements of the auxiliary electrode, the at least one substrate being configured to be positioned between at least two adjacent ones of main electrodes of the multipole ion guide device;

wherein the electrical elements include:

an array of finger electrodes disposed on the at least one substrate; and static resistors interconnecting respective ones of the finger electrodes for setting up a monotonically progressive voltage gradient in an axial direction of the multipole ion guide device for moving ions axially through the multipole ion guide device.

15. The auxiliary electrode of claim 14, wherein:

the at least one substrate comprises a thin plate;

the array of finger electrodes are disposed on the thin plate; and the electrical elements have a low profile or are integral with the thin plate such that the substrate with the electrical elements form a monolithic unit for positioning between the at least two adjacent electrodes of the multipole ion guide device.

16. The auxiliary electrode of claim 15, wherein:

the thin plate comprises a printed circuit board material and the array of finger electrodes comprises a printed conductive material;

the array of finger electrodes is disposed on opposite sides of the circuit board material; and the array of finger electrodes includes the printed conductive material on an edge of the printed circuit board joining the printed conductive material on opposite sides of the circuit board material and presenting the printed conductive material on a majority of a radially innermost edge surface of the auxiliary electrode.

17. The auxiliary electrode of claim 16, further comprising recesses in the edge of the printed circuit board material between respective finger electrodes of the finger electrode array such that available sites for ion deposit on an insulative material surface of the circuit board material are recessed radially outward away from the ion beam.

18. An auxiliary electrode for creating an ion moving axial electric field in a multipole ion guide device of a mass spectrometer, the auxiliary electrode comprising:

at least one substrate for supporting electrical elements of the auxiliary electrode, the at least one substrate being configured to be positioned between at least two adjacent ones of main electrodes of the multipole ion guide device;

wherein the electrical elements include:

an array of finger electrodes disposed on the at least one substrate; and one or more digital to analogue converters (DACs) connected to respective ones of the finger electrodes to apply respective DC voltages to create a DC voltage gradient in an axial direction of the multipole ion guide device for moving ions axially through the multipole ion guide device.

19. The auxiliary electrode of claim 18, wherein the one or more DACs comprises a dynamically adjustable DAC.

20. A monolithic drag field electrode for creating an ion moving electric field in a multipole ion guide device of a mass spectrometer, the monolithic drag field electrode comprising:

Silicon doped to have a resistance such that a voltage applied at a first end of the monolithic drag field electrode forms a monotonic voltage gradient along a length of the monolithic drag field electrode;

wherein the voltage gradient creates an axial electrical field along a length of the monolithic drag field electrode for moving ions axially through the multipole ion guide device.

* * * * *